US006085498A

United States Patent [19]

Hua

[11] Patent Number: 6,085,498

[45] Date of Patent: Jul. 11, 2000

[54] PACKING APPARATUS

[75] Inventor: Wei-Hsiu Hua, Taipei, Taiwan

[73] Assignee: Prudential Co., Ltd., Taipei, Taiwan

[21] Appl. No.: 09/265,843

[22] Filed: Mar. 10, 1999

[51] Int. Cl.[7] ..... B65B 67/08

[52] U.S. Cl. ..... 53/592; 140/93.4

[58] Field of Search ..... 53/592, 582, 138.1, 53/138.2; 140/93.4; 100/30

[56] References Cited

U.S. PATENT DOCUMENTS 3,411,551 11/1968 Plattner ..... 140/93.4

4,245,678 1/1981 Sansum ..... 53/592 X

*Primary Examiner*—Linda Johnson

*Attorney, Agent, or Firm*—Rosenberg, Klein & Lee

[57] ABSTRACT

Disclosed is a packing apparatus combining tape-tightening and hoop-flattening devices into one unit. The hoop-flattening device has a connecting plate mounted on a handle of the tape-tightening device, so that the hoop-flattening device is pivotally connected to a top of the tape-tightening device. When the hoop-flattening device is turned to a vertical position relative to the tape-tightening device, its front head presses down a braking plate pivotally connected at a front ring portion to a rotary shaft of the tape-tightening device, causing a push plate mounted in the handle to press a front end against a toothed wheel mounted around the rotary shaft for the toothed wheel to tightly pull a tape for packing a parcel. And, when the hoop-flattening device is turned to a horizontal position relative to the tape-tightening device and the braking plate is pulled downward at its rear end, the push plate is allowed to move away from the toothed wheel for the hoop-flattening device along the handle to be lifted into an upright position, so that the front head of the hoop-flattening device may flatten an iron hoop on the tape to firmly tie up the parcel.

3 Claims, 5 Drawing Sheets

PACKING APPARATUS

BACKGROUND OF THE INVENTION

The present invention relates to a packing apparatus, and more particularly to a packing apparatus that combines tape-tightening and hoop-flattening devices into one unit to enable continuous and efficient packing operation.

When packing a parcel and the like, it is usually to first tightly bind the parcel with a tape by using a tape-tightening device. Two ends of the tape are then threaded through an iron hoop before the iron hoop is flattened with a hoop-flattening device. Therefore, the two ends of the tape are tightly clamped together without the risk of becoming loosened.

Two different tools, namely, a tape-tightening device and a hoop-flattening device, are required to complete the above packing operation. An operator needs to repeatedly pick up and put down the two tools alternately. It is, of course, very troublesome to do so. Moreover, the operator might not effectively locate the tools if they are not positioned at fixed place. This would also, of course, adversely affect the efficiency of the packing operation.

SUMMARY OF THE INVENTION

It is therefore a primary object of the present invention to provide an improved packing apparatus that combines tape-tightening and hoop-flattening devices into one unit to enable continuous and efficient packing operation. To achieve the above and other objects of the present invention, the hoop-flattening device is pivotally connected to a top of a handle of the tape-tightening device and may be turned relative to the tape-tightening device between a vertical and a horizontal position. When the hoop-flattening device is in the vertical position, its front head presses down a braking plate pivotally connected at a front ring portion to a rotary shaft of the tape-tightening device, causing a push plate mounted in the handle to press its front end against a toothed wheel mounted around the rotary shaft for the toothed wheel to tightly pull a tape for packing a parcel. And, when the hoop-flattening device is in a horizontal position and the braking plate is pulled downward at its rear end, the push plate is allowed to move away from the toothed wheel for the hoop-flattening device along the handle to be lifted into an upright position, so that the front head of the hoop-flattening device may flatten an iron hoop on the tape to firmly tie the tape around the parcel.

BRIEF DESCRIPTION OF THE DRAWINGS

The above and other objects of the present invention and the features and functions thereof can be best understood by referring to the following detailed description of the preferred embodiments and the accompanying drawings, wherein.

DETAILED DESCRIPTION OF THE PREFERRED EMBODIMENTS

Figure 1:
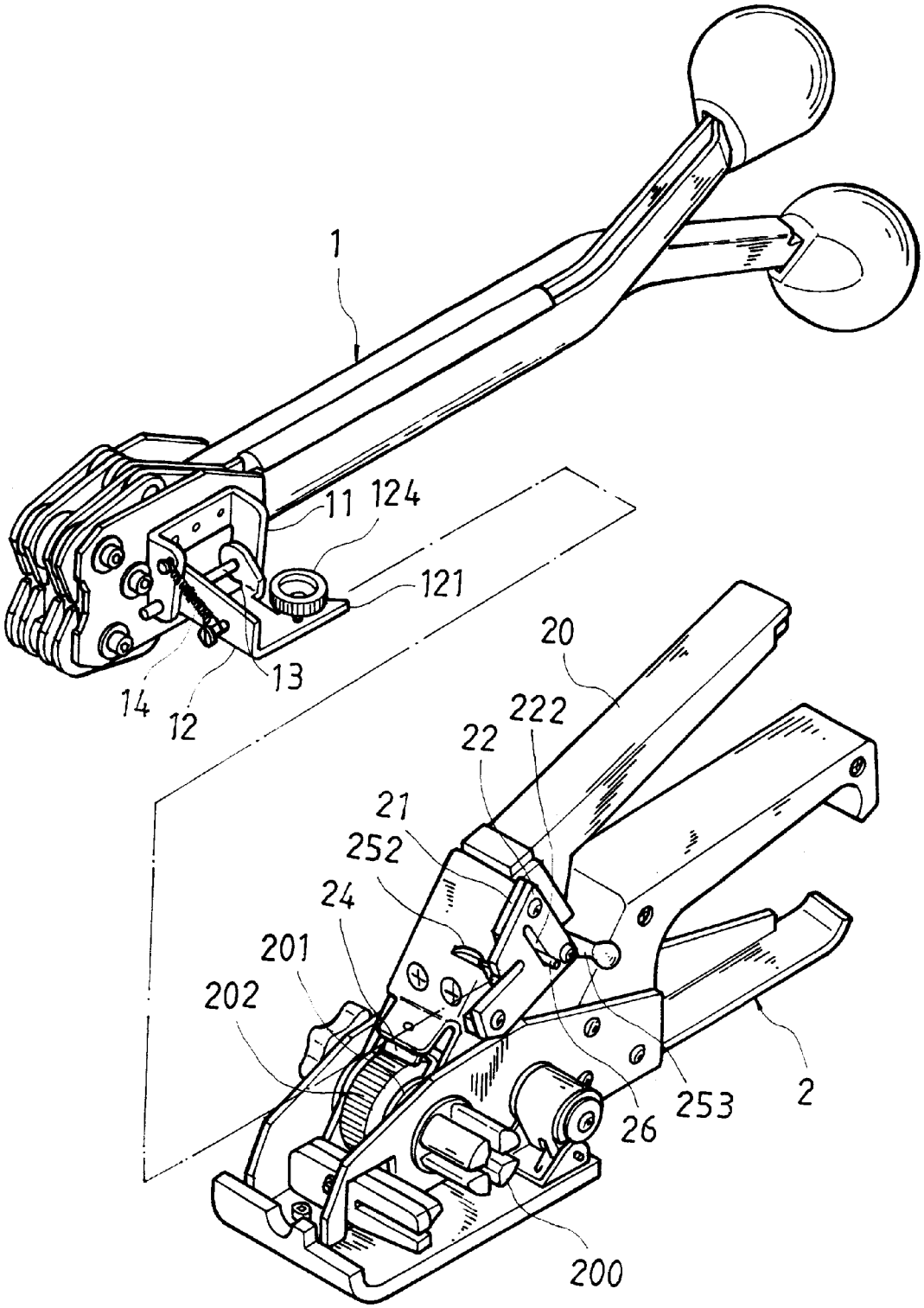
FIG. 1 is a perspective of the hoop-flattening device and the tape-tightening device included in the packing apparatus of the present invention.
Figures 2, 2A:
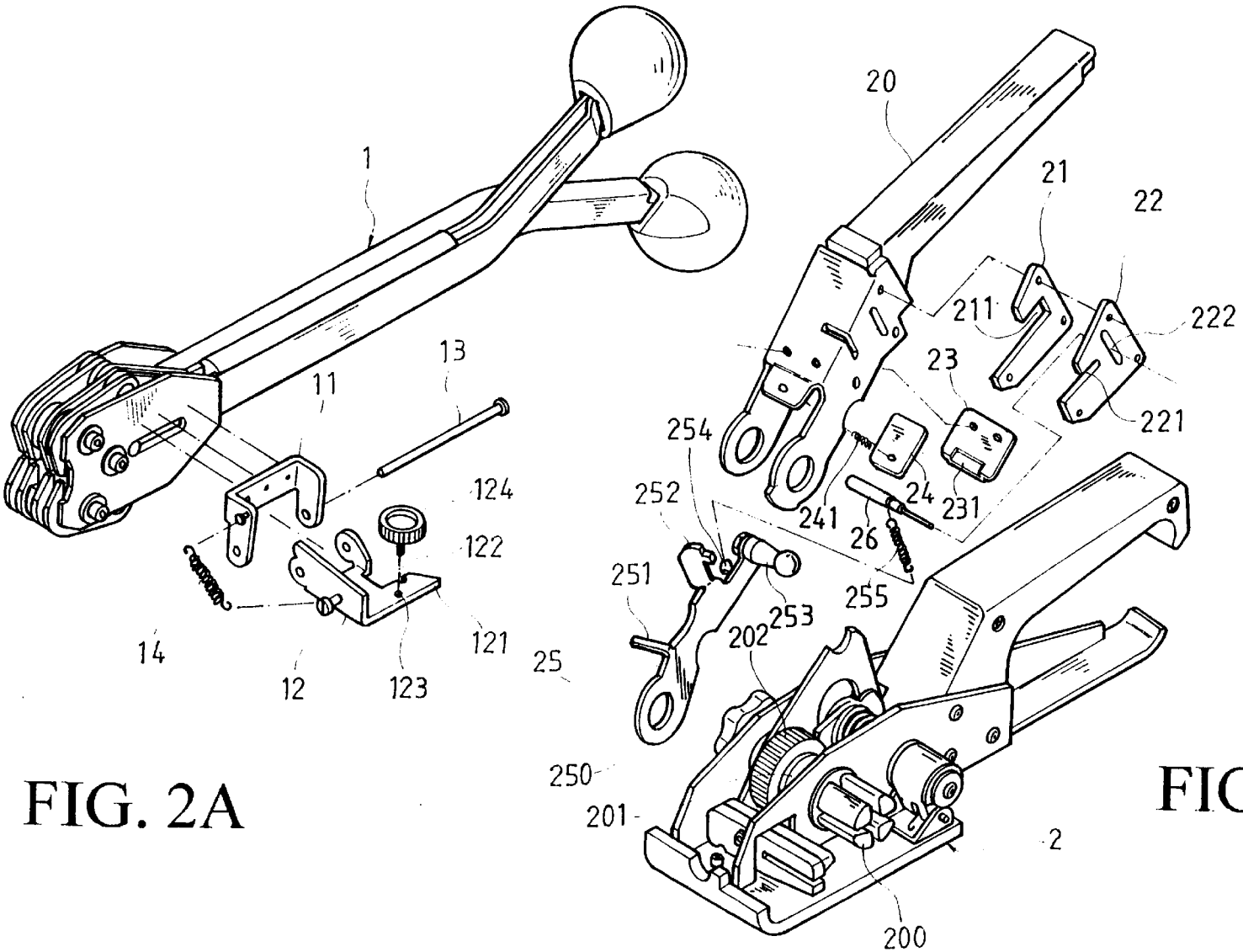
FIG. 2 is a partially exploded perspective of the packing apparatus of the present invention.

Please refer to FIGS. 1 and 2 that are assembled and partially exploded perspective views, respectively, of a packing apparatus according to the present invention. As shown, the packing apparatus mainly includes a hoop-flattening device 1 and a tape-tightening device 2.

The hoop-flattening device 1 is provided at one side of its front head portion with a substantially U-shaped bracket 11. A substantially L-shaped connecting plate 12 is pivotally connected at an inner edge to the U-shaped bracket 11 by a pivot pin 13. An outer corner of the connecting plate 12 forms a beveled nose 121. The beveled nose 121 is provided at an inner side facing the bracket 11 with a curved notch 122 and near an outer side (also an outer edge of the connecting plate 12) with a through hole 123. A turning knob 124 is rotatably mounted in the through hole 123. A first return spring 14 is provided at one side of the connecting plate 12 opposite to the nose 121 with its two ends separately connected to the bracket 11 and the connecting plate 12, such that the front head portion may be pivotally turned toward or away from the connecting plate 12 within an angular area defined by a spring force of the first return spring 14.

The tape-tightening device 2 includes a tape-tightening mechanism 200 and a handle portion 20 connected to a top of the tape-tightening mechanism 200. One lateral side of the handle portion 20 is provided with overlapped inner and outer triangular plates 21 and 22, respectively. The triangular plates 21 and 22 are formed of slide ways 211 and 221, respectively. The outer triangular plate 22 has an elongated slot 222 opposite and normal to the slide way 221. The slide way 211 on the inner triangular plate 21 is longer than the slide way 221 and extends to a point on the inner triangular plate 21 corresponding to the elongated slot 222 on the outer triangular plate 22. The beveled nose 121 on the connecting plate 12 may be slide toward and mounted between the overlapped inner and the outer triangular plates 21 and 22.

The handle portion 20 of the tape-tightening device 2 has a fixed plate 23 mounted to a bottom surface thereof. The fixed plate 23 has a front recess 231 for receiving a rear end of a push plate 24 therein. A compression spring 241 is connected at one end to a front end of the push plate 24 and at another end to the bottom surface of the handle portion 20.

The tape-tightening mechanism 200 includes a rotary shaft 201, around which a toothed wheel 202 is mounted. A braking plate 25 is pivotally connected at a front ring portion 250 to the rotary shaft 201. A braking bar 251 located behind the ring portion 250 sideward extends from an upper edge of the braking plate 25 in a direction opposite to the overlapped triangular plates 21, 22, such that the front end of the push plate 24 is located above the braking bar 251. A support 252 upward extends from a rear top of the braking plate 25 to project from a top surface of the handle portion 20 and a pull bar 253 sideward extends from a lower rear end of the braking plate 25 in a direction opposite to the braking bar 251 to project from a rear lower corner of the outer triangular plate 22. A small lever 254 is provided near the rear end of the braking plate 25 to sideward projects from one side of the braking plate 25 opposite to the pull bar 253. A retaining bar 26 is transversely mounted in the handle portion 20 with one end thereof extending through the slide way 211 on the inner triangular plate 21 and the elongated slot 222 on the outer triangular plate 22. A second return spring 255 is connected at one end to the lever 254 and at the other end to the retaining bar 26.

Figure 3:
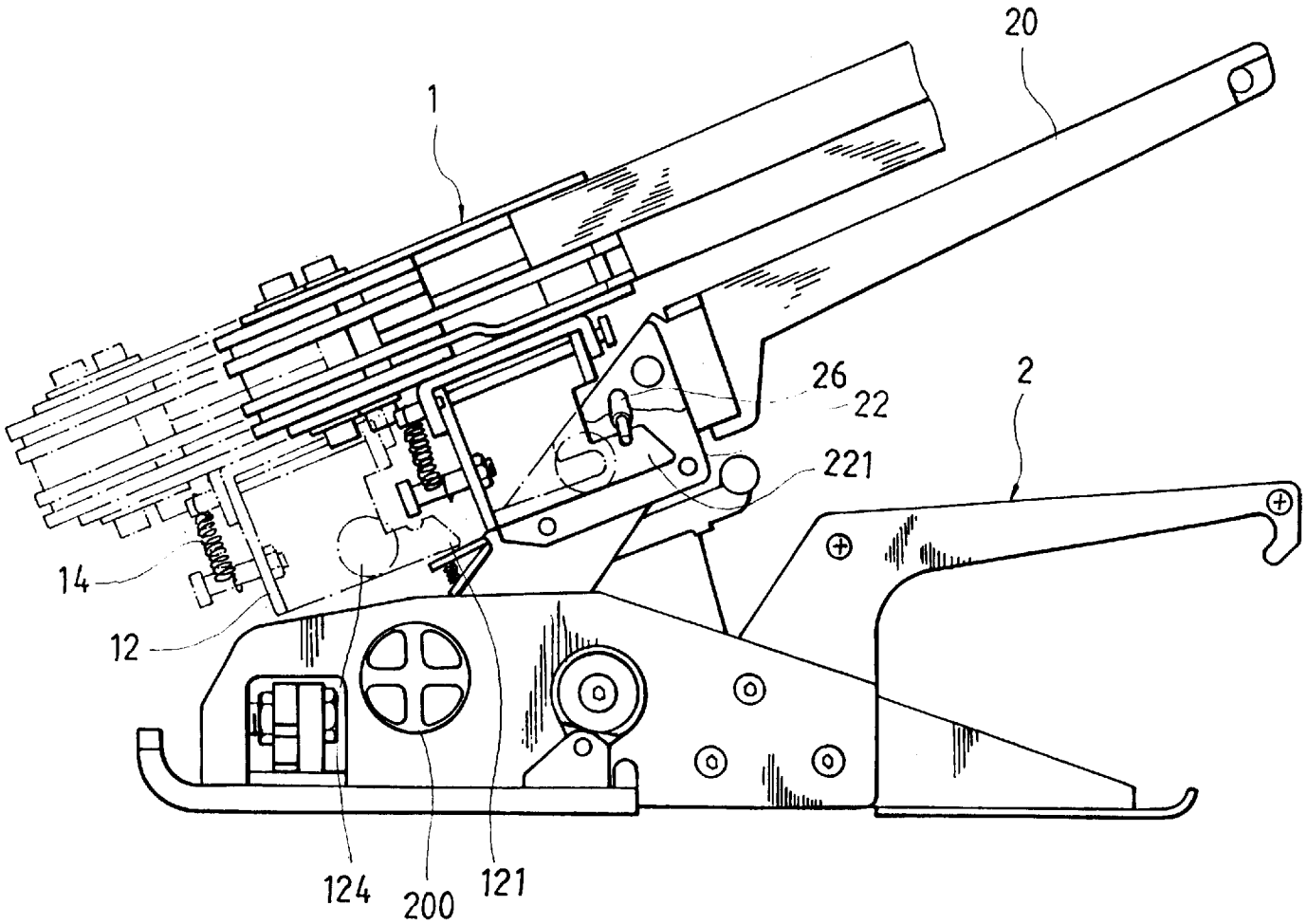
FIG. 3 illustrates the manner in which the hoop-flattening device and the tape-tightening device are connected together to form the packing apparatus of the present invention.

Please now refer to FIG. 3 that illustrates the manner in which the hoop-flattening device 1 is connected to a top of the handle portion 20 of the tape-tightening device 2. To connect the hoop-flattening device 1 to the top of the handle portion 20, first turn the hoop-flattening device 1 sideward so that the connecting plate 12 connected to its front head portion is perpendicular to the handle portion 20 of the tape-tightening device 2 with the beveled nose 121 pointing toward the overlapped triangular plates 21, 22. Then, move the hoop-flattening device 1 along the handle portion 20 to locate the beveled nose 121 between the inner and the outer triangular plates 21 and 22 with the curved notch 122 at inner side of the nose 121 engaging with the retaining bar 26 that has one end extended through the slide way 211 and the elongated slot 222. Meanwhile, the turning knob 124 is located outside the outer triangular plate 22 and moved along the slide way 221. By tightening the turning knob 124 toward the outer triangular plate 22, the hoop-flattening device 1 may be firmly connected to and located above the handle portion 20.

Figure 4:
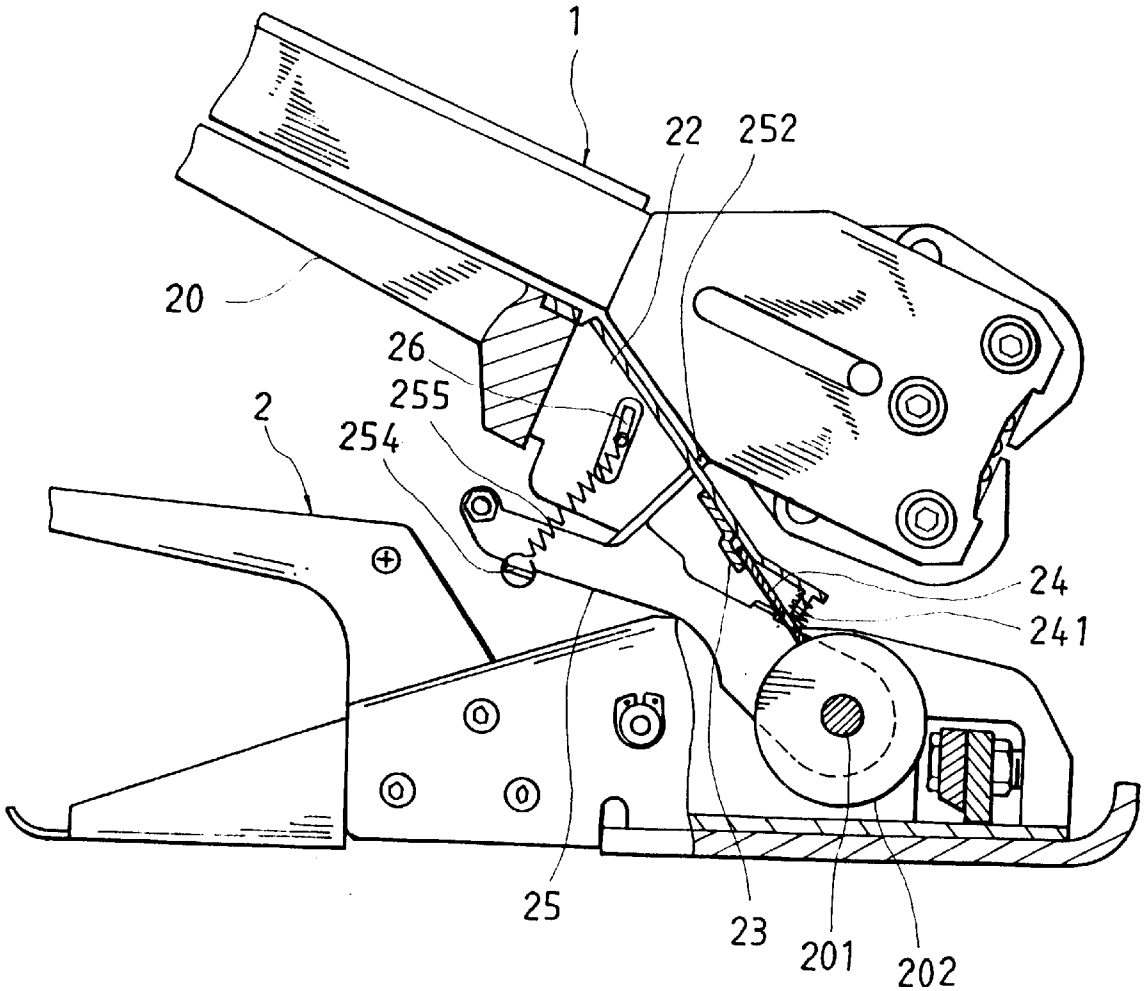
FIGS. 4 and 5 illustrate the manner in which the packing apparatus of the present invention is operated for use.

Please refer to FIGS. 2 and 4 at the same time. When using the packing apparatus of the present invention to pack a parcel and the like (not shown), first turn the hoop-flattening device 1 about the pivot pin 13, so that the front head portion of the device 1 is in a vertical position relative to the tape-tightening device 2. At this point, the front head portion of the device 1 has one lower side pressing against the support 252 that projects from the top surface of the handle portion 20 and thereby pushes the braking plate 25 downward. Meanwhile, the front end of the push plate 24 is pushed by the compression spring 241 to firmly press against the toothed wheel 202 on the tape-tightening mechanism 200 of the tape-tightening device 2. Whereby when the handle portion 20 of the device 2 and the hoop-flattening device 1 connected thereto are operated to pivotally move upward or downward relative to the tape-tightening mechanism 200, the toothed wheel 202 is pushed by the push plate 24 to pull and tighten a tape (not shown) for binding the parcel.

Figure 5:
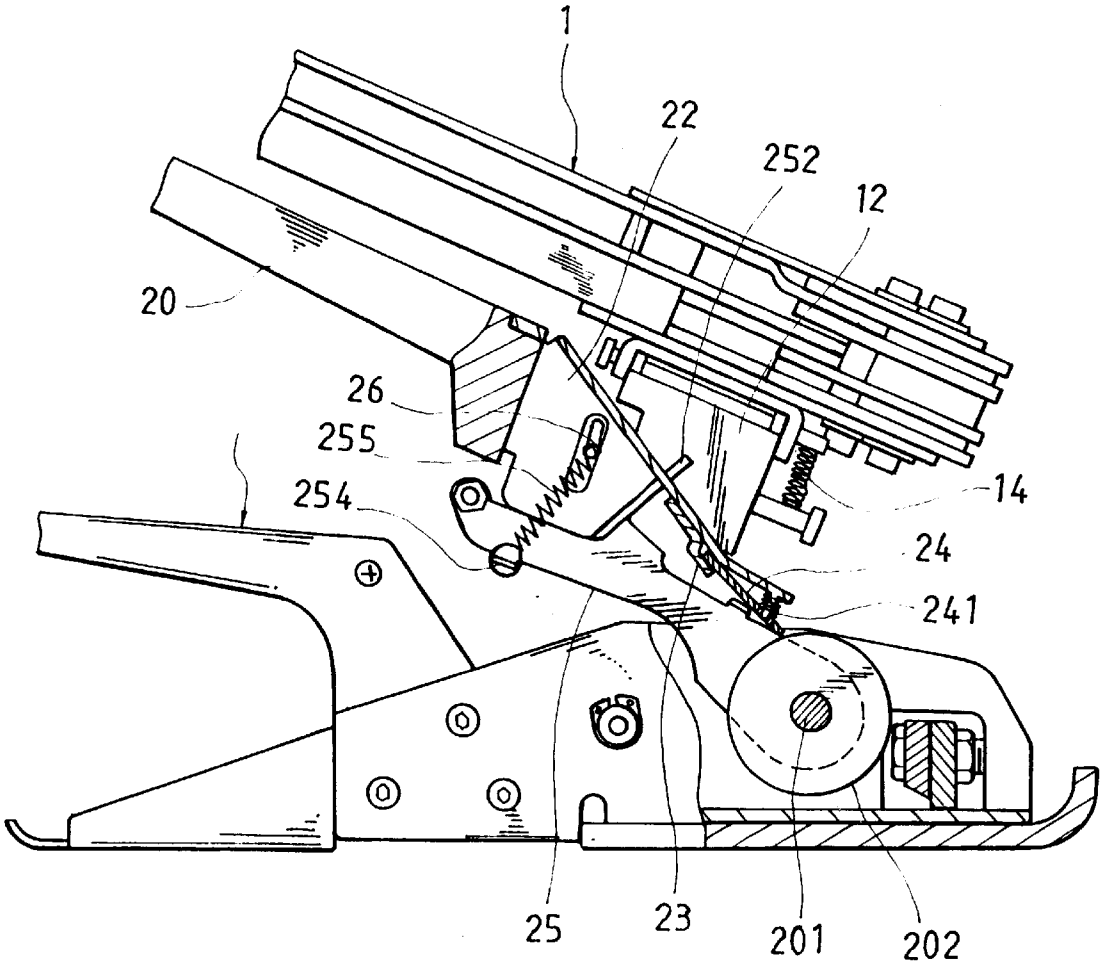

When the parcel is bound by the tape through the operation of the handle portion 20, the pull bar 253 that sideward projects from the handle portion 20 is downward pulled to disengage the braking plate 25 from the front head portion of the hoop-flattening device 1. At this point, the hoop-flattening device 1 may be turned about the pivot pin 13 again to have the front head portion located horizontally above the handle portion 20, as shown in FIG. 5. After the pull bar 253 is released, the braking plate 25 is immediately pulled upward by the second return spring 255. At this point, the braking bar 251 on the upward moving braking plate 25 would contact with and push the push plate 24 away from the toothed wheel 202, allowing the hoop-flattening device 1 and the handle portion 20 to be pivotally turned relative to the tape-tightening mechanism 200 to an upright position with the front head portion of the hoop-flattening device 1 pointing downward. In this position, the hoop-flattening device 1 may be used to flatten an iron hoop (not shown) on the tape to firmly tie the tape around the parcel.

What is claimed is:

1. A packing apparatus comprising a tape-tightening device and a hoop-flattening device pivotally connected to a top of a handle portion of said tape-tightening device by tightly connecting a first connecting means provided at one lateral side of a front head portion of said hoop-flattening device to a second connecting means provided at one lateral side of said handle portion of said tape-tightening device;

said first connecting means on said hoop-flattening device including a substantially U-shaped bracket fixedly mounted on said lateral side of said front head portion, a substantially L-shaped connecting plate pivotally connected at an inner edge to said U-shaped bracket by a pivot pin, and a first return spring having two ends separately connected to said U-shaped bracket and said L-shaped connecting plate; and said connecting plate being formed at a rear outer corner with a beveled nose and at an inner side of said beveled nose facing said bracket with a curved notch;

said second connecting means on said tape-tightening device including overlapped inner and outer triangular plates mounted on said lateral side of said handle portion, said outer triangular plate being formed of a first slide way and an inclined elongated slot opposite and normal to said first slide way and said inner triangular plate being formed of a second slide way, such that a retaining bar transversely fixed in said handle portion may extend an end through said second slide way on said inner triangular plate and said elongated slot on said outer triangular plate; and said L-shaped connecting plate of said first connecting means being fixedly mounted between said inner and said outer triangular plates with said curved notch at said beveled nose engaged with said retaining bar extending through said second slide way and said elongated slot on said inner and said outer triangular plates, respectively; and said handle portion being pivotally connected to a top of a tape-tightening mechanism of said tape-tightening device, said tape-tightening mechanism including a rotary shaft, a toothed wheel mounted around said rotary shaft, a braking plate pivotally connected at a front ring portion to said rotary shaft and distantly and elastically connected at a rear end to said retaining bar via a second return spring having two ends separately connected to a lever on said braking plate and said retaining bar, and a push plate; said braking plate having a sideward extended top braking bar located behind said ring portion and below said push plate, a support at an upper rear end and upward projected from said handle portion, and a sideward extended pull bar at a lower rear end opposite to said braking bar and projected from said handle portion below and behind said overlapped triangular plates; and said push plate having a rear end received in a narrow space defined by a fixed plate mounted in the handle portion and a front end pressing against a compression spring provided below an upper front end of said handle portion;

whereby when said hoop-flattening device is turned about said pivot pin relative to said tape-tightening device to have said front head portion in a vertical position, said front head portion would press against said support projected from said handle portion and accordingly push said braking plate downward, allowing said compression spring to push the front end of said push plate against said toothed wheel for said toothed wheel to tightly pull a tape for tying around a parcel; and when said hoop-flattening device is turned from said vertical position to a horizontal position relative to said tape-tightening device, said hoop-flattening device can be lifted along with said handle portion to an upright position with said front head portion facing downward to facilitate flattening of an iron hoop on said tape to firmly tie up the parcel.

2. A packing apparatus as claimed in claim 1, wherein said L-shaped connecting plate of said first connecting means is provided with a through hole for a turning knob to rotatably mount therein; said turning knob being extended through said first slide way on said outer triangular plate, said through hole on said connecting plate, and said second slide way on said inner triangular plate, and tightened against said handle portion.

3. A packing apparatus as claimed in claim 1, wherein said second slide way extends to a point on said inner triangular plate corresponding to said elongated slot on said outer triangular plate for said retaining bar to easily engage with said curved notch on said first connecting means.

* * * * *